US007819267B2

(12) United States Patent
Kick

(10) Patent No.: US 7,819,267 B2
(45) Date of Patent: Oct. 26, 2010

(54) FLIP TOP CLOSURE FOR DISPENSING FLUENT PRODUCT

(75) Inventor: James Kick, Town and Country, MO (US)

(73) Assignee: C.A.P.S., Inc., Bridgeton, MO (US)

( * ) Notice: Subject to any disclaimer, the term of this patent is extended or adjusted under 35 U.S.C. 154(b) by 627 days.

(21) Appl. No.: 11/404,177

(22) Filed: Apr. 14, 2006

(65) Prior Publication Data

US 2006/0237388 A1 Oct. 26, 2006

Related U.S. Application Data

(60) Provisional application No. 60/672,924, filed on Apr. 19, 2005.

(51) Int. Cl.
*B65D 39/00* (2006.01)

(52) U.S. Cl. ..... 215/235; 215/237; 220/254.3; 220/254.5; 220/835; 220/838; 220/839; 222/556

(58) Field of Classification Search ..... 215/224, 215/228, 235, 236, 237; 222/556; 220/810, 220/836, 837, 324, 839, 254.3, 254.5, 835, 220/838

See application file for complete search history.

(56) References Cited

U.S. PATENT DOCUMENTS

| | | | | | |
|---|---|---|---|---|---|
| 3,323,671 | A | * | 6/1967 | Minarik, Jr. et al. | 215/237 |
| 4,022,352 | A | * | 5/1977 | Pehr | 222/153.14 |
| 4,291,818 | A | | 9/1981 | Nozawa et al. | |
| 4,403,712 | A | | 9/1983 | Wiesinger | |
| 4,457,458 | A | * | 7/1984 | Heinol | 222/498 |
| 4,545,508 | A | | 10/1985 | Cribb, Jr. et al. | |
| 4,911,337 | A | * | 3/1990 | Rosenthal | 222/498 |
| 4,936,494 | A | | 6/1990 | Weidman | |
| 4,941,592 | A | * | 7/1990 | Kitterman | 222/23 |
| 5,038,957 | A | * | 8/1991 | Gross | 220/840 |
| D331,878 | S | | 12/1992 | Forsyth | |
| D334,538 | S | | 4/1993 | Bolen, Jr. et al. | |
| RE34,263 | E | | 5/1993 | vanKerkhoven et al. | |
| D339,065 | S | | 9/1993 | Forsyth et al. | |
| D340,187 | S | | 10/1993 | Forsyth | |
| 5,330,082 | A | | 7/1994 | Forsyth | |
| 5,499,736 | A | * | 3/1996 | Kohl | 220/254.5 |
| 5,769,253 | A | * | 6/1998 | Gross | 215/237 |
| 6,039,197 | A | * | 3/2000 | Braun | 215/228 |
| D448,296 | S | | 9/2001 | Bried et al. | |
| RE37,634 | E | | 4/2002 | Hickman et al. | |
| 6,510,971 | B1 | | 1/2003 | Martin | |
| D476,892 | S | | 7/2003 | Martin | |
| D509,426 | S | | 9/2005 | Samz et al. | |
| D529,800 | S | | 10/2006 | Liebe | |
| 2002/0125203 | A1 | * | 9/2002 | Bried et al. | 215/235 |

* cited by examiner

*Primary Examiner*—Anthony Stashick
*Assistant Examiner*—Elizabeth Volz
(74) *Attorney, Agent, or Firm*—Polster Lieder Woodruff & Lucchesi, L.C.

(57) ABSTRACT

A closure for a container is disclosed having an end wall with one or more product dispensing openings therein. The closure has a flip open lid hingedly connected to the outer edge of the end wall and movable between a closed and an open position. The end wall has stiffening shoulders on opposite sides of the hinge and extending proximate the edges of the lid so as to stiffen the end wall against deformation upon application of the closure to the container.

87 Claims, 2 Drawing Sheets

FLIP TOP CLOSURE FOR DISPENSING FLUENT PRODUCT

CROSS REFERENCE TO RELATED APPLICATIONS

This application claims priority to U.S. Provisional Application Ser. No: 60/672,924, filed Apr. 19, 2005, which is hereby incorporated by reference.

STATEMENT REGARDING FEDERALLY SPONSORED RESEARCH

Not applicable.

BACKGROUND OF THE INVENTION

This invention relates to a closure for consumer containers as may be used to package spices, sugar, powdered drink mixes, salt or other dry, fluent (flowable) materials or products. More specifically, this invention relates to such a closure which may be used with small containers with a flip open lid that exposes one or more product dispensing holes through which the product may be poured, shaken or spooned from the container.

In the high-speed packaging of dry, fluent products, a pre-measured quantity (either a pre-determined weight or volume) of the product is discharged into the container. Oftentimes, a tamper-evident, tear-off seal is adhered to the mouth of the container after filling of the container. These containers typically have a screw-on closure which is threaded onto the threaded neck of the container by high-speed capping equipment incorporated in the product filling line. Such capping equipment oftentimes applies more torque to the closure than is necessary to insure that the closure is tightly screwed onto the container. In the past, this excess torque applied to the closure caused the closure to deform as it was screwed tightly to the container, which, in turn, caused a flip open lid formed with the closure to become unseated from the remainder of the closure and to partially open or to open. With the lid in a partially open position, the container could become jammed in the filling line, or the partially open lids would not allow the containers to be packaged in overcartons using automated equipment. In addition, such partially open lids may cause the filled package to be automatically rejected by the filling line or by inspectors. Still further, even if the lid would remain closed during filling and packing in overcartons, the stress imposed on the closure during the capping operation would, on occasion, cause the flip open lids to become unseated during shipping or while the container was on a store shelf prior to being purchased by a consumer. Such partially open lids would cause the container to be seen by the store clerks or the consumer as defective because the clerk or the consumer may believe that the product had been opened or contaminated, even though a taper-evident seal applied to the mouth of the container under the closure remained intact. As will be appreciated, such containers having the above-described tamper-evident seals applied to the mouth of the container must be removed prior to use by unscrewing the closure from the container, removing the seal, and then screwing the closure back onto the container. On occasion, the consumer (customer) may, when using the container, over-tighten the closure thus resulting in a similar deformation such that the flip open lid will not stay in its closed position. This, of course, my result in the spillage of the contents of the container or it may result in the degradation of the contents.

There has long been a need for a flip open, screw-on closure that better resisted deformation during the capping operation, particularly if the closure was screwed onto the container with more torque than was necessary. There has also been a need for such a flip-open closure where the lid will remain secured in its closed position during shipping, and while the product is displayed on store shelves and is used by the consumer.

BRIEF SUMMARY OF THE INVENTION

Among the several objects and features of the closure herein described is the provision of a closure having a flip open lid where the closure resists deformation upon being tightly applied (e.g., screwed) onto its container either by automated capping equipment or by hand thereby insuring that its flip open lid remains closed;

The provision of such a closure that has a flush upper surface when the flip open lid is in its closed position; and The provision of such a closure which, while resisting deformation caused by over-torquing, is of light-weight construction, which is easy to mold, and which is economical to manufacture.

It will be appreciated that some of the above objects and features may be applicable to only some of the claims hereinafter presented and that the closures described in the claims need not include all of the above-noted features or advantages.

Other objects and features of the closure herein described will be in part apparent and in part disclosed herein.

The closure herein described is intended for use with a container, where the container has a neck and a mouth at the upper end of the neck. The closure has a lower closure body having a downwardly depending skirt for sealable connection to the mouth of the container. A end wall extends across the upper end of the lower closure body for closing the end of the closure and of the container when the closure is applied to the container. The end wall has one or more openings therethrough for the dispensing of a fluent (loose or flowable) product contained within the container. A flip-open lid is hingedly connected to the closure by a hinge for movement of the lid relative to the closure between a closed position in which the lid overlies and closes the opening(s) in the end wall and an open position in which the lid is clear of the openings thereby to permit the dispensing of the product. A snap lock is provided for retaining thelid in its closed position. The closure has a shoulder integrally formed with the upper end wall on opposite sides of the hinge for stiffening the end wall against deformation upon application of the closure to the container.

BRIEF DESCRIPTION OF THE DRAWINGS

Corresponding reference characters indicate corresponding parts throughout the several views of the drawings.

DETAILED DESCRIPTION OF THE INVENTION

Figure 5:
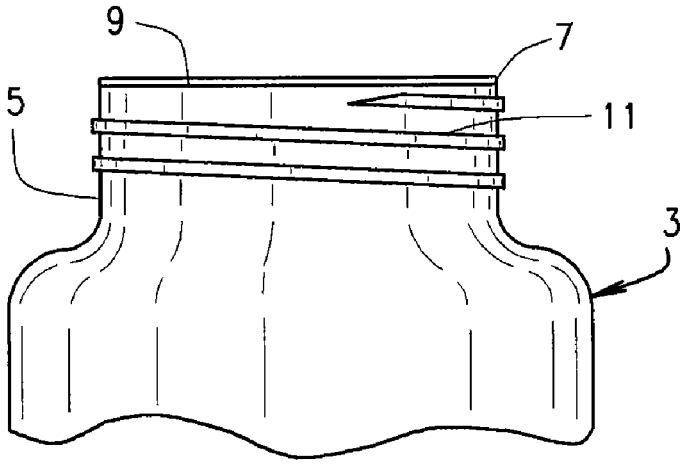
FIG. 5 is a side elevational view of a typical container to which the closure of this invention is threadably applied.

Referring now to the drawings, one embodiment of the closure of the present invention is indicated in its entirety by reference character 1. The closure is adapted to be applied, preferably (but not necessarily) threaded, onto a container 3. As shown in FIG. 5, container 3 has a neck 5 with the mouth 7 of the container at the upper end of the neck. As is conventional, a tear away tamper evident seal 9 is adhered to the mouth of the container. External threads 11 are formed on the outer surface of the container neck so that the closure 1 may be screwed onto the neck of the container in the conventional manner.

Figure 4:
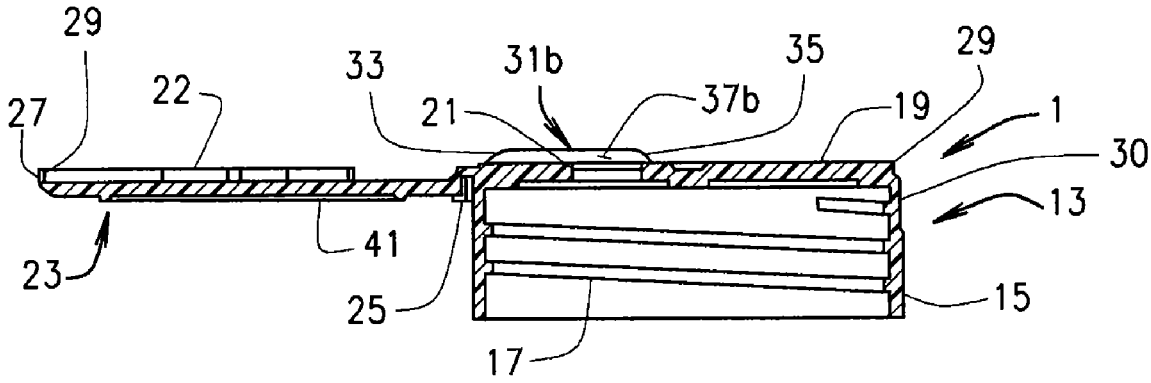
FIG. 4 a cross sectional view taken along line 4-4 of FIG. 3 with the flip open lid in its open position.

Closure 1 has a lower body portion, as generally indicated at 13, having a downwardly extending cylindrical skirt 15. As shown in FIG. 4, internal threads 17 are formed on the inner wall of skirt 15 for threadable engagement with threads 11 on the neck of its container 3 so that closure may be sealably secured to the container. While the closure is preferably threadably secured to its container, those skilled in the art will understand that the closure may be secured to the container by other suitable means well-known in the closure field, such as using a push-in closure which is adhered to its container by an adhesive. Such a "push in" skirt is shown in U.S. Pat. No. RE 34,263, which is herein incorporated by reference.

Closure 1 has an upper end wall 19 extending across the upper end of lower body portion 13 and closing the closure and the upper end of container 3. The end wall is provided with one or more product dispensing openings, as indicated at 21. It will be understood that the number and size of the openings may be varied, depending on the product to be contained in container 3 and the method of dispensing that is desired for the product. As shown, five (5) of such product openings are used where each opening is relatively large. Such openings are preferable when dispensing a flowable or fluent, dry product such as Parmesan cheese or flake spices (e.g., basil or parsley). Those skilled in the art will appreciate that smaller opening may be preferred in dispensing products having a finer granular form, such as popcorn salt or the like.For such fine products, more than five (5) holes may be preferred. For certain products, particularly products used in baking, such as baking powder, where the end-user spoons the product from the container, only a single opening for accommodating a spoon may be preferred. Also, those skilled in the art will understand that for closures of a larger size than is shown in the drawings, a combination of different groups of openings may be used for different dispensing applications.

Further, closure 1 has a flip-open lid, as generally indicated at 23, which is hingedly connected to the upper portion of lower body portion 13 by a hinge 25 integrally molded to skirt 15 and to lid 23. Preferably, hinge 25 is adjacent the periphery of the closure. While a number of different hinge designs may be used, a so-called "bow tie" hinge design is preferred. Such "bow tie" hinges are well known to those skilled in the closure field. Lid 23 has a distal edge end 27 generally opposite hinge 25 and a snap lock closure 29 carried by the distal edge of the lid opposite the hinge. A variety of snap lock closures for such flip open lids are widely used in the closure field and any of these well known designs would be suitable for use with the closure of the present invention. These snap lock closures typically operate to engage a portion of the lid with a receptacle in the upper edge of the lower body portion 13 when the lid is forced to its fully closed position. In order to open such snap locks, a fingernail groove 30 is provided in the upper edge of the lower body portion 13 of the closure so that an end-user may more readily grip only the lid 23 to force it open.

Figure 1:
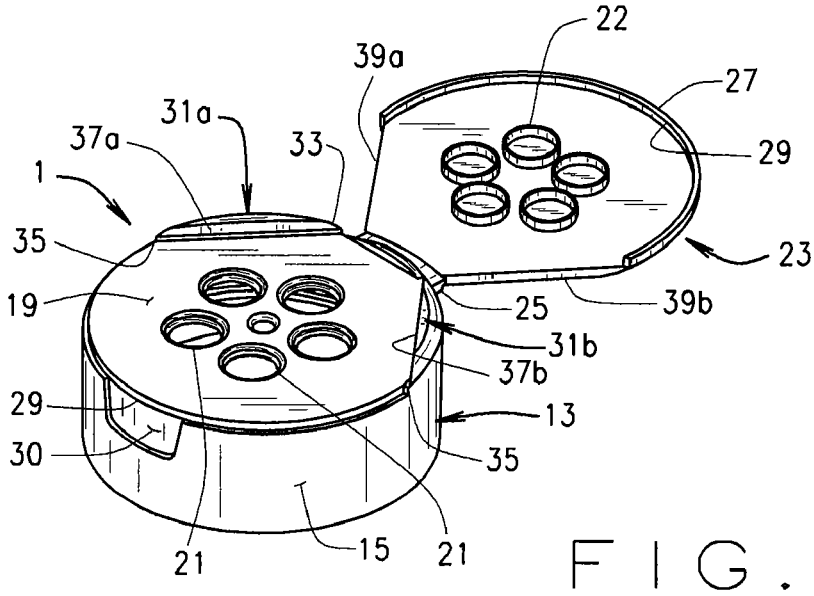
FIG. 1 is a perspective view of one embodiment of the closure of the present invention having a lower body portion, and end wall, and a flip-open lid in its open position.
Figure 2:
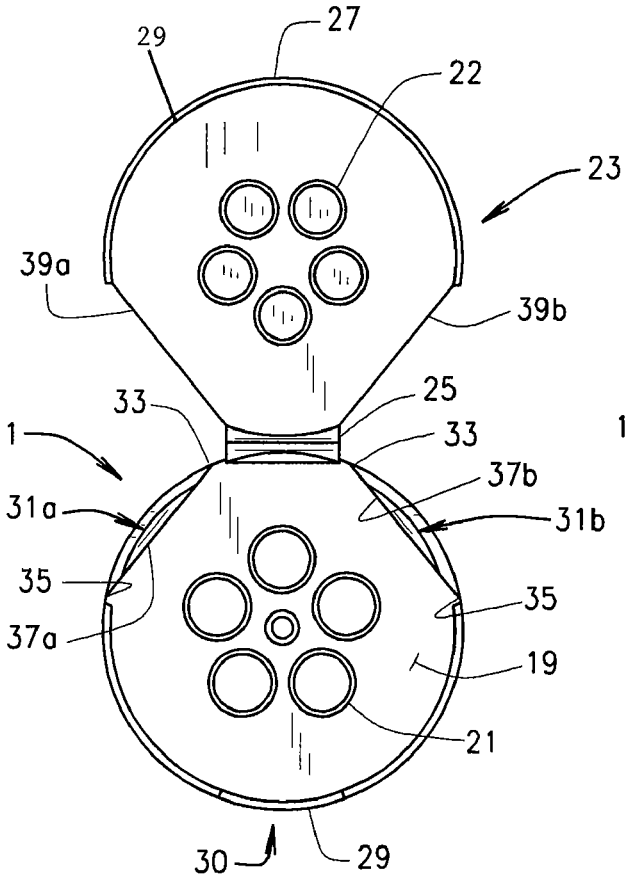
FIG. 2 is top plan view of the closure with its flip-open lid in its fully open position.

As best shown in FIGS. 1 and 2, the underside of lid 23 may optionally be provided with bosses 22 configured to be tightly received in holes 21 when the lid is in its closed position so as to aid in sealing the container when the lid is closed.

Figure 3:
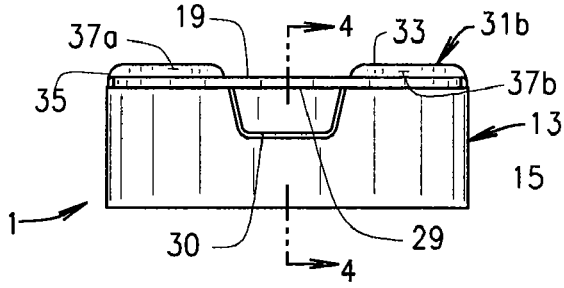
FIG. 3 is a front side elevational view of the closure shown in FIG. 1 with the flip-open lid in its closed position.

As generally indicated at 31*a*, 31*b* and as best shown in FIGS. 1 and 2, a pair of stiffening shoulders 31*a*, 31*b* is integrally formed or molded with closure 1, and more specifically molded with the upper edges of lower body portion 13 and with end wall 19. Each stiffening shoulder 31*a*, 31*b* has a proximate end 33 adjacent hinge 25 and a distal end 35. As shown and as is preferable, the stiffening shoulders 31*a*, 31*b* are symmetrical with respect to a centerline of the closure 1 passing through hinge 25 such that the stiffening shoulders 31*a*, 31*b* are substantially identical and are symmetrical with respect to the hinge 25. Each of the stiffening shoulders 31*a*, 31*b* has an inner edge 37*a*, 37*b*. Lid 23 has a corresponding side edge 39*a*, 39*b* inboard of shoulders 31*a*, 31*b* so as to be in close proximity to the inner edges 37*a*, 37*b* of the shoulders 31*a*, 31*b*. As shown in FIGS. 1, 3 and 4, shoulders 31*a*, 31*b* extend up above the level of end wall 19 such that the closure 1 is substantially thicker (and thus stiffer) in the areas of the stiffening shoulders 31*a*, 31*b*. Those skilled in the art will appreciate that the stiffening shoulders 31*a*, 31*b* thus stiffen and resist deformation of the closure 1 as it is forcibly threaded onto container 3. It will be understood that the stiffening shoulders 31*a*, 31*b* of closure 1 make it less likely for the closure 1 to be deformed when it is screwed onto the container 3 and thus the tendency of flip lid 23 to come open, during filling, shipping, retail display, and during use by the end-user is minimized.

As will be appreciated, flip lid 23 has an upper surface 41 (as shown in FIG. 4). When the flip lid is in its closed position, the height of the flip lid corresponds to the height of the stiffening shoulders 31*a*, 31*b* such that the top surfaces of the stiffening shoulders and the top surface of the flip lid are substantially flush with one another (co-planar). That is, with the flip lid closed, the lid does not protrude above the level of the stiffening shoulders, unless some decorative design is molded on the upper surface of the flip lid.

Depending on the shape and/or size of closure 1, other arrangements of the stiffening shoulders 31*a*, 31*b* of this invention may be employed. For example, on larger size closures, each of the stiffening shoulders 31*a*, 3*b* may have two or more segments (not shown) similar to shoulders 31*a*, 31*b* shown in FIG. 2 with the outermost segment extending from the outer end of the first segment so as to extend around the periphery of the closure 1 toward snap lock 29 thereby to provide additional stiffening distal from the hinge 25 for such larger size closures.

While the present invention has been described by reference to specific embodiments, it should be understood that modifications and variations of the invention may be constructed without departing from the scope of the invention defined in the following claims.

The invention claimed is:

1. A closure for a container, the container having a neck and a mouth at an upper end of said neck, said closure comprising:

a downwardly depending skirt having an upper end and a bottom end and a periphery defining a perimeter of the closure for sealable connection to the mouth of said container, an end wall having a top planar surface coupled to and extending diametrically across the upper end of said skirt and about a substantial portion of the periphery for closing the upper end of said skirt and the mouth of said container when said closure is applied to said container, said end wall having an area defined within the upper end of the skirt defining one or more openings therethrough for the dispensing of a product contained within said container, a flip-open lid hingedly connected by a hinge to a side of the skirt about the perimeter of said closure for movement of said lid relative to said end wall between a closed position in which said lid overlies and closes said one or more openings in said end wall and an open position in which said lid is clear of said one or more openings for permitting the dispensing of said product, the lid having two side edges and an outer edge defining a portion of a periphery of the lid and a top lid surface, each side edge having a proximal end adjacent a different side of the hinge on the skirt and angling outwardly from the hinge at increasing distances from the opposing side edge to a distal end defining a different end of the outer edge, and a snap lock for retaining said lid in its closed position, wherein said end wall having shoulders integrally formed with said end wall and said skirt proximate the upper end of said skirt on opposite sides of said lid hinge, each shoulder having a substantial portion formed as an upward extension of the skirt and an insubstantial portion located above the end wall free of the skirt, said shoulders extending upwardly from the top planar surface of the end wall and proximate to and spaced upwardly from a portion of a periphery of the end wall with each shoulder having a proximal end adjacent one side of the hinge and an inner side edge angling outwardly away from the hinge and corresponding to the angle of the side edges of the lid, a distal end at about the periphery of the skirt, the inner edge defined between the proximal end and the distal end, a peripheral surface extending upward from the periphery and spaced upwardly from the upper end of the skirt and extending upwardly from the top planar surface of the end wall defining a top shoulder surface that is substantially flush with the top lid surface when the lid is in the closed position, wherein the end wall has a substantially planar top surface throughout the area of the end wall in regions free of the shoulders, wherein said shoulders at least in part extend across portions of said end wall such that the thickness of said end wall in the regions of said shoulders is substantially thicker than a thickness of said end wall free of the shoulders.

2. The closure of claim 1 wherein each shoulder and the end wall having each shoulder have a solid formation.

3. The closure as set forth in claim 1 wherein the end wall has a lower surface defining a void in the region below the shoulders.

4. The closure as set forth in claim 1 wherein the shoulders are a pair of shoulders, each shoulder of the pair being positioned on opposing sides of the hinge, and wherein each shoulder of the pair is symmetrical with respect to the hinge and with respect to a centerline of the end wall defined by the hinge.

5. The closure of claim 1 wherein each of the shoulders has two segments with a first segment being positioned proximate to the hinge and an outermost segment extending from an outer end of the first segment so as to extend around the perimeter of the closure from the hinge toward the snap lock.

6. The closure of claim 1 wherein the snap lock includes a downwardly projecting lip from the outer edge of the lid, and wherein the upper end of the skirt defines a receptacle extending between the distal ends of the shoulder and configured for receiving the downwardly projection lip of the outer edge of the lid when the lid is in the closed position.

7. The closure of claim 1 wherein the outer edge of the lid extends over the upper end of the skirt and wherein a substantially planar top surface of the closure has an area defined by the perimeter consists of the top surface of the lid and the top surface of the shoulders when the lid is in the closed position.

8. The closure of claim 1 wherein the snap lock is positioned opposite of the hinge and wherein each shoulder includes two or more segments with an outermost segment extending from an outer end of a first segment positioned proximate to the hinge around the perimeter of the closure towards the snap lock.

9. The closure of claim 1 wherein each shoulder being integrally formed as an upward extension of the end wall wherein the end wall has no upward extension spaced apart upwardly from the plane of the end wall other than the shoulders and each shoulder includes an upward extension of the skirt that is spaced upwardly from the upper end of the skirt to the top shoulder surface, and wherein each of the shoulders has a substantially solid formation.

10. The closure as set forth in claim 9 wherein the end wall has a lower surface that is substantially planar and free of a void in the region below the shoulders.

11. The closure as set forth in claim 1 wherein the end wall has an area defined by the upper end of the skirt and wherein the lid is dimensioned to cover the area of the end wall free of the shoulders and to cover the upper end of the skirt free of the shoulders when the lid is in the closed position.

12. The closure as set forth in claim 11 wherein the one or more openings is a single opening and wherein the single opening defines an open area covering a substantial portion of the area of the end wall located between the two shoulders and towards an outer portion of the end wall on a side opposing the hinge.

13. The closure as set forth in claim 11 wherein the lid is dimensioned to cover all of the area of the end wall including the upper end of the skirt other than the shoulders.

14. The closure as set forth in claim 1 wherein said side edges of the lid extending from said hinge such that when said lid is in its closed position, said outwardly angled lid side edges are inboard of and contiguous to the outwardly angled inner edges of said shoulders.

15. The closure as set forth in claim 14 wherein said lid outer edge is opposite said hinge and is defined by the distal ends of said side edges, said outer edge being substantially co-extensive with the periphery of said skirt between distal ends of said shoulders.

16. The closure of claim 15 wherein the outer edge of the lid and an outer edge of the skirt defined between the distal ends of the shoulders each extend 180 degrees or more about the perimeter of the closure.

17. A closure for a container, the container having a neck and a mouth at an end of the neck, the closure comprising:

a downwardly depending skirt for sealable connection to the mouth of the container, the skirt having an upper edge, a lower edge, an inner surface and an outer surface defining a periphery of the skirt and a perimeter of the closure;

an end wall coupled at the upper edge of the skirt and extending diametrically across the upper edge of the skirt for closing the skirt and for closing the container when the closure is applied to the container, the end wall having a top planar surface extending about a substantial portion of the periphery, an area defined by the upper edge of the skirt and an opening therethrough for the dispensing of a product contained within the container;

a flip-open lid configured for moving over the end wall between an open position for exposing the opening and a closed position for closing the opening, the lid having a snap lock for selectively securing the lid in the closed position, the lid having two linear side edges outwardly angled at increasing distances apart from each other from a proximal end and a distal end, and a semi-circular outer edge defined between the distal ends of the two side edges and a top lid surface:

a hinge integrally formed with the lid and a side of the skirt and configured for hingedly connecting the flip-open lid for the movement of the lid relative to the end wall between the closed position in which the lid closes the opening in the end wall and the open position in which the lid is clear of the opening for permitting the dispensing of the product through the opening, wherein each proximal end of the two side edges of the lid are proximate to a different side of the hinge; and a pair of shoulders integrally formed with the end wall and the skirt, each shoulder extending upwardly from the end wall and spaced upwardly from the upper edge of the skirt, each shoulder having a substantial portion formed as an upward extension of the skirt and an insubstantial portion located above the end wall free of the skirt, each shoulder being symmetrically positioned on opposing sides of the hinge in a position that angles outwardly from the hinge at the same angle as one of the side edges of the lid, the shoulders having a top surface and having inner linear edges configured for receiving the side edges of the lid between the two shoulders when the lid is in the closed position, wherein the lid is dimensioned to substantially overlay the area of the end wall free of the shoulders and the upper edge of the skirt free of the shoulders, wherein a thickness of the end wall containing the shoulders is substantially greater than a thickness of the end wall free of the shoulders.

18. The closure as set forth in claim 17 wherein each shoulder has a proximal end positioned proximate to a different side of the hinge and originating at the periphery of the skirt, a distal end located proximate to the periphery of the skirt and opposing the hinge, the top surface of each shoulder being substantially parallel to the planar top surface of the end wall, and a peripheral surface defined as a substantially contiguous upward extension of the periphery of the skirt, wherein a top surface of the closure consists of the top surface of the shoulders and the top surface of the lid when in the closed position.

19. The closure as set forth in claim 17 wherein the side edges of the lid are inboard of the inner edge of the shoulders and the top surface of the lid is substantially planar with the top surface of each shoulder when the lid is in the closed position.

20. The closure as set forth in claim 17 wherein the shoulders being integrally formed as an upward extension of the end wall that has no upward extension spaced apart upwardly from the plane of the end wall other than the shoulders and an upward extension of the skirt and wherein each of the shoulders has a substantially solid formation.

21. The closure as set forth in claim 17 wherein the end wall has a lower surface that is substantially planar and free of a void in the region below the shoulders.

22. The closure as set forth in claim 17 wherein the end wall has a lower surface that is substantially planar and defining a void in the region below the shoulders.

23. A closure for a container, the container having a neck and a mouth at an end of the neck, the closure having a downwardly depending skirt for sealable connection to the mouth of the container, the skirt having an upper edge, a lower edge, an inner surface and an outer surface having a periphery defining a perimeter of the closure, the closure further having an end wall coupled at the upper edge of the skirt for closing the skirt and for closing the container when the closure is applied to the container, the end wall having a substantially planar surface with an opening therethrough for the dispensing of a product contained within the container, the closure further comprising:

the end wall defining the top planar surface extending diametrically across the upper end of the skirt and about a substantial portion of the periphery defined by the skirt;

a flip-open lid having a hinge edge, two linear side edges having proximal ends and distal ends, an outer edge defined between the distal ends, and an exposed top surface, the two linear side edges outwardly angled at increasing distances apart from each other from the proximal ends to the distal ends, the lid being configured for moving over the end wall between an open position for exposing the opening and a closed position for closing the opening, the outer edge having downwardly extending lip defining a snap lock for selectively securing the lid in the closed position, the outer edge having a semi-circular shape defined between the distal ends of the two side linear edges on an opposing side to the hinge edge;

a hinge integrally formed with the lid about a hinge edge and with a side of the skirt, the hinge being configured for hingedly connecting the lid for the movement of the lid relative to the end wall between the closed position in which the lid closes the opening in the end wall and the open position in which the lid is clear of the opening for permitting the dispensing of the product through the opening, wherein each proximal end of the side edges of the lid are proximate to a different side of the hinge; and a pair of shoulders integrally formed with the end wall and the skirt proximate to the upper edge of the skirt, each shoulder extending upwardly from the end wall and spaced upwardly from the upper edge of the skirt, each shoulder having a substantial portion formed as an upward extension of the skirt and an insubstantial portion located above the end wall free of the skirt, each shoulder being on opposing sides of the hinge and having an linear inner edge that angles outwardly from the hinge at increasing distances at the same angle as the angles of the side edges of the lid for positioning next to one of the side edges of the lid when the lid is in the closed position, the shoulders having a monolithic body formed as an upward extension of the end wall and an upward extension of the skirt and having a combined thickness with the end wall that is substantially greater than a thickness of the end wall in regions free of the shoulders, and having an upper surface substantially planar with the exposed top surface of the lid when the lid is in the closed position, wherein the lid is dimensioned to overlay the end wall that is free of the shoulders and to overlay the upper edge of the skirt that is free of the shoulders, and wherein the skirt defines a receptacle about the upper edge in portions of the skirt free of the shoulders and wherein the receptacle is configured for receiving the downwardly extending lip of the lid when the lid is in the closed position.

24. The closure as set forth in claim 23 wherein each of the shoulders has a substantially solid formation.

25. The closure as set forth in claim 23 wherein the end wall has a lower surface that is substantially planar and free of a void in the region below the shoulders.

26. A closure for a container, the container having a neck and a mouth at an end of the neck, the closure comprising:

a downwardly depending skirt for sealable connection to the mouth of the container, the skirt having an upper edge with a portion including a receptacle, a lower edge, an inner surface and an outer surface defining a periphery of the skirt and a perimeter of the closure;

an end wall coupled at and diametrically across the upper edge of the skirt for closing the skirt and for closing the container when the closure is applied to the container, the end wall having a top planar surface extending about a substantial portion of the periphery and an area defined by the upper edge of the skirt, the end wall having a single opening therethrough for the dispensing of a product contained within the container;

a flip-open lid configured for moving over the end wall between an open position for exposing the opening and a closed position for closing the opening, the lid having a snap lock for coupling with the receptacle of the skirt and selectively securing the lid in the closed position, the lid having a top lid surface, two linear side edges outwardly angled at increasing distances apart between a proximal end and a distal end, and a semi-circular outer edge defined between the distal ends of the two side edges;

a hinge integrally formed with the lid and a side of the skirt and configured for hingedly connecting the flip-open lid for the movement of the lid relative to the end wall between the closed position in which the lid substantially closes the opening in the end wall and the open position in which the lid is clear of the opening for permitting the dispensing of the product through the opening, wherein each proximal end of the two side edges of the lid are proximate to a different side of the hinge; and a pair of shoulders integrally formed with the end wall and the skirt proximate to the upper edge of the skirt, each shoulder extending upwardly from the end wall and spaced upwardly from the upper edge of the skirt, each shoulder having a substantial portion formed as an upward extension of the skirt and an insubstantial portion located above the end wall free of the skirt, each shoulder being symmetrically positioned on opposing sides of the hinge in a position that angles outwardly from the hinge at the same angle as one of the side edges of the lid outwardly angle, the shoulders having a top surface and inner edges configured for receiving the side edges of the lid between the two shoulders when the lid is in the closed position, wherein the opening in the end wall includes a substantial portion of the area of the end wall positioned between the two symmetrical shoulders, wherein the lid overlies the end wall free of the shoulders and the upper edge of the skirt free of the shoulders and wherein a top surface of the closure consists of the top surface of the pair of shoulders and the top surface of the lid.

27. A closure for a container, the container having a neck and a mouth at an upper end of said neck, said closure comprising:

a downwardly depending skirt having an upper end and a bottom end and a periphery defining a perimeter of the closure for sealable connection to the mouth of said container, an end wall having a top planar surface coupled to and extending diametrically across the upper end of said skirt and about a substantial portion of the periphery for closing the upper end of said skirt and the mouth of said container when said closure is applied to said container, said end wall having an area defined within the upper end of the skirt defining one or more openings therethrough for the dispensing of a product contained within said container, a flip-open lid hingedly connected by a hinge to a side of the skirt about the perimeter of said closure for movement of said lid relative to said end wall between a closed position in which said lid overlies and closes said one or more openings in said end wall and an open position in which said lid is clear of said one or more openings for permitting the dispensing of said product, the lid having two side edges and an outer edge defining a portion of a periphery of the lid and a top lid surface, each side edge having a proximal end adjacent a different side of the hinge on the skirt and angling outwardly from the hinge at increasing distances from the opposing side edge to a distal end defining a different end of the outer edge, and a snap lock for retaining said lid in its closed position, wherein said end wall having shoulders integrally formed with said end wall and said skirt proximate the upper end of said skirt on opposite sides of said lid hinge, each shoulder having a substantial portion formed as an upward extension of the skirt and an insubstantial portion located above the end wall free of the skirt, said shoulders extending upwardly from the top planar surface of the end wall and proximate to and spaced upwardly from a portion of a periphery of the end wall with each shoulder having a proximal end adjacent one side of the hinge and an inner side edge angling outwardly away from the hinge and corresponding to the angle of the side edges of the lid, a distal end at about the periphery of the skirt, the inner edge defined between the proximal end and the distal end, a peripheral surface extending upward from the periphery and spaced upwardly from the upper end of the skirt and extending upwardly from the top planar surface of the end wall defining a top shoulder surface that is substantially flush with the top lid surface when the lid is in the closed position, wherein the end wall has a substantially planar top surface throughout the area of the end wall in regions free of the shoulders wherein said side edges of the lid extending from said hinge such that when said lid is in its closed position, said outwardly angled lid side edges are inboard of and contiguous to the outwardly angled inner edges of said shoulders, wherein said lid outer edge is opposite said hinge and is defined by the distal ends of said side edges, said outer edge being substantially co-extensive with the periphery of said skirt between distal ends of said shoulders wherein the outer edge of the lid and an outer edge of the skirt defined between the distal ends of the shoulders each extend 180 degrees or more about the perimeter of the closure.

28. The closure set forth in claim 27 wherein said shoulders at least in part extend across portions of said end wall such that the thickness of said end wall in the regions of said shoulders is substantially thicker than a thickness of said end wall free of the shoulders.

29. The closure of claim 27 wherein each shoulder and the end wall having each shoulder have a solid formation.

30. The closure as set forth in claim 27 wherein the end wall has a lower surface defining a void in the region below the shoulders.

31. The closure as set forth in claim 27 wherein the shoulders are a pair of shoulders, each shoulder of the pair being positioned on opposing sides of the hinge, and wherein each shoulder of the pair is symmetrical with respect to the hinge and with respect to a centerline of the end wall defined by the hinge.

32. The closure of claim 27 wherein each of the shoulders has two segments with a first segment being positioned proximate to the hinge and an outermost segment extending from an outer end of the first segment so as to extend around the perimeter of the closure from the hinge toward the snap lock.

33. The closure of claim 27 wherein the snap lock includes a downwardly projecting lip from the outer edge of the lid, and wherein the upper end of the skirt defines a receptacle extending between the distal ends of the shoulder and configured for receiving the downwardly projection lip of the outer edge of the lid when the lid is in the closed position.

34. The closure of claim 27 wherein the outer edge of the lid extends over the upper end of the skirt and wherein a substantially planar top surface of the closure has an area defined by the perimeter consists of the top surface of the lid and the top surface of the shoulders when the lid is in the closed position.

35. The closure of claim 27 wherein the snap lock is positioned opposite of the hinge and wherein each shoulder includes two or more segments with an outermost segment extending from an outer end of a first segment positioned proximate to the hinge around the perimeter of the closure towards the snap lock.

36. The closure as set forth in claim 27 wherein said side edges of the lid extending from said hinge such that when said lid is in its closed position, said outwardly angled lid side edges are inboard of and contiguous to the outwardly angled inner edges of said shoulders.

37. The closure as set forth in claim 36 wherein said lid outer edge is opposite said hinge and is defined by the distal ends of said side edges, said outer edge being substantially co-extensive with the periphery of said skirt between distal ends of said shoulders.

38. The closure of claim 27 wherein each shoulder being integrally formed as an upward extension of the end wall wherein the end wall has no upward extension spaced apart upwardly from the plane of the end wall other than the shoulders and each shoulder includes an upward extension of the skirt that is spaced upwardly from the upper end of the skirt to the top shoulder surface, and wherein each of the shoulders has a substantially solid formation.

39. The closure as set forth in claim 38 wherein the end wall has a lower surface that is substantially planar and free of a void in the region below the shoulders.

40. The closure as set forth in claim 27 wherein the end wall has an area defined by the upper end of the skirt and wherein the lid is dimensioned to cover the area of the end wall free of the shoulders and to cover the upper end of the skirt free of the shoulders when the lid is in the closed position.

41. The closure as set forth in claim 40 wherein the one or more openings is a single opening and wherein the single opening defines an open area covering a substantial portion of the area of the end wall located between the two shoulders and towards an outer portion of the end wall on a side opposing the hinge.

42. The closure as set forth in claim 40 wherein the lid is dimensioned to cover all of the area of the end wall including the upper end of the skirt other than the shoulders.

43. A closure for a container, the container having a neck and a mouth at an upper end of said neck, said closure comprising:

a downwardly depending skirt having an upper end and a bottom end and a periphery defining a perimeter of the closure for sealable connection to the mouth of said container, an end wall having a top planar surface coupled to and extending diametrically across the upper end of said skirt and about a substantial portion of the periphery for closing the upper end of said skirt and the mouth of said container when said closure is applied to said container, said end wall having an area defined within the upper end of the skirt defining one or more openings therethrough for the dispensing of a product contained within said container, a flip-open lid hingedly connected by a hinge to a side of the skirt about the perimeter of said closure for movement of said lid relative to said end wall between a closed position in which said lid overlies and closes said one or more openings in said end wall and an open position in which said lid is clear of said one or more openings for permitting the dispensing of said product, the lid having two side edges and an outer edge defining a portion of a periphery of the lid and a top lid surface, each side edge having a proximal end adjacent a different side of the hinge on the skirt and angling outwardly from the hinge at increasing distances from the opposing side edge to a distal end defining a different end of the outer edge, and a snap lock for retaining said lid in its closed position, wherein said end wall having shoulders integrally formed with said end wall and said skirt proximate the upper end of said skirt on opposite sides of said lid hinge, each shoulder having a substantial portion formed as an upward extension of the skirt and an insubstantial portion located above the end wall free of the skirt, said shoulders extending upwardly from the top planar surface of the end wall and proximate to and spaced upwardly from a portion of a periphery of the end wall with each shoulder having a proximal end adjacent one side of the hinge and an inner side edge angling outwardly away from the hinge and corresponding to the angle of the side edges of the lid, a distal end at about the periphery of the skirt, the inner edge defined between the proximal end and the distal end, a peripheral surface extending upward from the periphery and spaced upwardly from the upper end of the skirt and extending upwardly from the top planar surface of the end wall defining a top shoulder surface that is substantially flush with the top lid surface when the lid is in the closed position, wherein the end wall has a substantially planar top surface throughout the area of the end wall in regions free of the shoulders, wherein each shoulder being integrally formed as an upward extension of the end wall wherein the end wall has no upward extension spaced apart upwardly from the plane of the end wall other than the shoulders and each shoulder includes an upward extension of the skirt that is spaced upwardly from the upper end of the skirt to the top shoulder surface, and wherein each of the shoulders has a substantially solid formation.

44. The closure set forth in claim 43 wherein said shoulders at least in part extend across portions of said end wall such that the thickness of said end wall in the regions of said shoulders is substantially thicker than a thickness of said end wall free of the shoulders.

45. The closure of claim 43 wherein the outer edge of the lid and an outer edge of the skirt defined between the distal ends of the shoulders each extend 180 degrees or more about the perimeter of the closure.

46. The closure as set forth in claim 43 wherein the end wall has a lower surface that is substantially planar and free of a void in the region below the shoulders.

47. The closure as set forth in claim 43 wherein the shoulders are a pair of shoulders, each shoulder of the pair being positioned on opposing sides of the hinge, and wherein each shoulder of the pair is symmetrical with respect to the hinge and with respect to a centerline of the end wall defined by the hinge.

48. The closure of claim 43 wherein each of the shoulders has two segments with a first segment being positioned proximate to the hinge and an outermost segment extending from an outer end of the first segment so as to extend around the perimeter of the closure from the hinge toward the snap lock.

49. The closure of claim 43 wherein the snap lock includes a downwardly projecting lip from the outer edge of the lid, and wherein the upper end of the skirt defines a receptacle extending between the distal ends of the shoulder and configured for receiving the downwardly projection lip of the outer edge of the lid when the lid is in the closed position.

50. The closure of claim 43 wherein the outer edge of the lid extends over the upper end of the skirt and wherein a substantially planar top surface of the closure has an area defined by the perimeter consists of the top surface of the lid and the top surface of the shoulders when the lid is in the closed position.

51. The closure of claim 43 wherein the snap lock is positioned opposite of the hinge and wherein each shoulder includes two or more segments with an outermost segment extending from an outer end of a first segment positioned proximate to the hinge around the perimeter of the closure towards the snap lock.

52. The closure as set forth in claim 43 wherein said side edges of the lid extending from said hinge such that when said lid is in its closed position, said outwardly angled lid side edges are inboard of and contiguous to the outwardly angled inner edges of said shoulders.

53. The closure as set forth in claim 52 wherein said lid outer edge is opposite said hinge and is defined by the distal ends of said side edges, said outer edge being substantially co-extensive with the periphery of said skirt between distal ends of said shoulders.

54. The closure as set forth in claim 43 wherein the end wall has an area defined by the upper end of the skirt and wherein the lid is dimensioned to cover the area of the end wall free of the shoulders and to cover the upper end of the skirt free of the shoulders when the lid is in the closed position.

55. The closure as set forth in claim 54 wherein the one or more openings is a single opening and wherein the single opening defines an open area covering a substantial portion of the area of the end wall located between the two shoulders and towards an outer portion of the end wall on a side opposing the hinge.

56. The closure as set forth in claim 54 wherein the lid is dimensioned to cover all of the area of the end wall including the upper end of the skirt other than the shoulders.

57. A closure for a container, the container having a neck and a mouth at an upper end of said neck, said closure comprising:

a downwardly depending skirt having an upper end and a bottom end and a periphery defining a perimeter of the closure for sealable connection to the mouth of said container, an end wall having a top planar surface coupled to and extending diametrically across the upper end of said skirt and about a substantial portion of the periphery for closing the upper end of said skirt and the mouth of said container when said closure is applied to said container, said end wall having an area defined within the upper end of the skirt defining one or more openings therethrough for the dispensing of a product contained within said container, a flip-open lid hingedly connected by a hinge to a side of the skirt about the perimeter of said closure for movement of said lid relative to said end wall between a closed position in which said lid overlies and closes said one or more openings in said end wall and an open position in which said lid is clear of said one or more openings for permitting the dispensing of said product, the lid having two side edges and an outer edge defining a portion of a periphery of the lid and a top lid surface, each side edge having a proximal end adjacent a different side of the hinge on the skirt and angling outwardly from the hinge at increasing distances from the opposing side edge to a distal end defining a different end of the outer edge, and a snap lock for retaining said lid in its closed position, wherein said end wall having shoulders integrally formed with said end wall and said skirt proximate the upper end of said skirt on opposite sides of said lid hinge, each shoulder having a substantial portion formed as an upward extension of the skirt and an insubstantial portion located above the end wall free of the skirt, said shoulders extending upwardly from the top planar surface of the end wall and proximate to and spaced upwardly from a portion of a periphery of the end wall with each shoulder having a proximal end adjacent one side of the hinge and an inner side edge angling outwardly away from the hinge and corresponding to the angle of the side edges of the lid, a distal end at about the periphery of the skirt, the inner edge defined between the proximal end and the distal end, a peripheral surface extending upward from the periphery and spaced upwardly from the upper end of the skirt and extending upwardly from the top planar surface of the end wall defining a top shoulder surface that is substantially flush with the top lid surface when the lid is in the closed position, wherein the end wall has a substantially planar top surface throughout the area of the end wall in regions free of the shoulders, wherein each shoulder and the end wall having each shoulder have a solid formation.

58. The closure set forth in claim 57 wherein said shoulders at least in part extend across portions of said end wall such that the thickness of said end wall in the regions of said shoulders is substantially thicker than a thickness of said end wall free of the shoulders.

59. The closure of claim 57 wherein the outer edge of the lid and an outer edge of the skirt defined between the distal ends of the shoulders each extend 180 degrees or more about the perimeter of the closure.

60. The closure as set forth in claim 57 wherein the shoulders are a pair of shoulders, each shoulder of the pair being positioned on opposing sides of the hinge, and wherein each shoulder of the pair is symmetrical with respect to the hinge and with respect to a centerline of the end wall defined by the hinge.

61. The closure of claim 57 wherein each of the shoulders has two segments with a first segment being positioned proximate to the hinge and an outermost segment extending from an outer end of the first segment so as to extend around the perimeter of the closure from the hinge toward the snap lock.

62. The closure of claim 57 wherein the snap lock includes a downwardly projecting lip from the outer edge of the lid, and wherein the upper end of the skirt defines a receptacle extending between the distal ends of the shoulder and configured for receiving the downwardly projection lip of the outer edge of the lid when the lid is in the closed position.

63. The closure of claim 57 wherein the outer edge of the lid extends over the upper end of the skirt and wherein a substantially planar top surface of the closure has an area defined by the perimeter consists of the top surface of the lid and the top surface of the shoulders when the lid is in the closed position.

64. The closure of claim 57 wherein the snap lock is positioned opposite of the hinge and wherein each shoulder includes two or more segments with an outermost segment extending from an outer end of a first segment positioned proximate to the hinge around the perimeter of the closure towards the snap lock.

65. The closure as set forth in claim 57 wherein said side edges of the lid extending from said hinge such that when said lid is in its closed position, said outwardly angled lid side edges are inboard of and contiguous to the outwardly angled inner edges of said shoulders.

66. The closure as set forth in claim 65 wherein said lid outer edge is opposite said hinge and is defined by the distal ends of said side edges, said outer edge being substantially co-extensive with the periphery of said skirt between distal ends of said shoulders.

67. The closure of claim 57 wherein each shoulder being integrally formed as an upward extension of the end wall wherein the end wall has no upward extension spaced apart upwardly from the plane of the end wall other than the shoulders and each shoulder includes an upward extension of the skirt that is spaced upwardly from the upper end of the skirt to the top shoulder surface.

68. The closure as set forth in claim 67 wherein the end wall has a lower surface that is substantially planar and free of a void in the region below the shoulders.

69. The closure as set forth in claim 57 wherein the end wall has an area defined by the upper end of the skirt and wherein the lid is dimensioned to cover the area of the end wall free of the shoulders and to cover the upper end of the skirt free of the shoulders when the lid is in the closed position.

70. The closure as set forth in claim 69 wherein the one or more openings is a single opening and wherein the single opening defines an open area covering a substantial portion of the area of the end wall located between the two shoulders and towards an outer portion of the end wall on a side opposing the hinge.

71. The closure as set forth in claim 69 wherein the lid is dimensioned to cover all of the area of the end wall including the upper end of the skirt other than the shoulders.

72. A closure for a container, the container having a neck and a mouth at an upper end of said neck, said closure comprising:

a downwardly depending skirt having an upper end and a bottom end and a periphery defining a perimeter of the closure for sealable connection to the mouth of said container, an end wall having a top planar surface coupled to and extending diametrically across the upper end of said skirt and about a substantial portion of the periphery for closing the upper end of said skirt and the mouth of said container when said closure is applied to said container, said end wall having an area defined within the upper end of the skirt defining one or more openings therethrough for the dispensing of a product contained within said container, a flip-open lid hingedly connected by a hinge to a side of the skirt about the perimeter of said closure for movement of said lid relative to said end wall between a closed position in which said lid overlies and closes said one or more openings in said end wall and an open position in which said lid is clear of said one or more openings for permitting the dispensing of said product, the lid having two side edges and an outer edge defining a portion of a periphery of the lid and a top lid surface, each side edge having a proximal end adjacent a different side of the hinge on the skirt and angling outwardly from the hinge at increasing distances from the opposing side edge to a distal end defining a different end of the outer edge, and a snap lock for retaining said lid in its closed position, wherein said end wall having shoulders integrally formed with said end wall and said skirt proximate the upper end of said skirt on opposite sides of said lid hinge, each shoulder having a substantial portion formed as an upward extension of the skirt and an insubstantial portion located above the end wall free of the skirt, said shoulders extending upwardly from the top planar surface of the end wall and proximate to and spaced upwardly from a portion of a periphery of the end wall with each shoulder having a proximal end adjacent one side of the hinge and an inner side edge angling outwardly away from the hinge and corresponding to the angle of the side edges of the lid, a distal end at about the periphery of the skirt, the inner edge defined between the proximal end and the distal end, a peripheral surface extending upward from the periphery and spaced upwardly from the upper end of the skirt and extending upwardly from the top planar surface of the end wall defining a top shoulder surface that is substantially flush with the top lid surface when the lid is in the closed position, wherein the end wall has a substantially planar top surface throughout the area of the end wall in regions free of the shoulders, wherein the snap lock includes a downwardly projecting lip from the outer edge of the lid, and wherein the upper end of the skirt defines a receptacle extending between the distal ends of the shoulder and configured for receiving the downwardly projection lip of the outer edge of the lid when the lid is in the closed position.

73. The closure set forth in claim 72 wherein said shoulders at least in part extend across portions of said end wall such that the thickness of said end wall in the regions of said shoulders is substantially thicker than a thickness of said end wall free of the shoulders.

74. The closure of claim 72 wherein the outer edge of the lid and an outer edge of the skirt defined between the distal ends of the shoulders each extend 180 degrees or more about the perimeter of the closure.

75. The closure of claim 72 wherein each shoulder and the end wall having each shoulder have a solid formation.

76. The closure as set forth in claim 72 wherein the end wall has a lower surface defining a void in the region below the shoulders.

77. The closure as set forth in claim 72 wherein the shoulders are a pair of shoulders, each shoulder of the pair being positioned on opposing sides of the hinge, and wherein each shoulder of the pair is symmetrical with respect to the hinge and with respect to a centerline of the end wall defined by the hinge.

78. The closure of claim 72 wherein each of the shoulders has two segments with a first segment being positioned proximate to the hinge and an outermost segment extending from an outer end of the first segment so as to extend around the perimeter of the closure from the hinge toward the snap lock.

79. The closure of claim 72 wherein the outer edge of the lid extends over the upper end of the skirt and wherein a substantially planar top surface of the closure has an area defined by the perimeter consists of the top surface of the lid and the top surface of the shoulders when the lid is in the closed position.

80. The closure of claim 72 wherein the snap lock is positioned opposite of the hinge and wherein each shoulder includes two or more segments with an outermost segment extending from an outer end of a first segment positioned proximate to the hinge around the perimeter of the closure towards the snap lock. surface of the shoulders when the lid is in the closed position.

81. The closure as set forth in claim 72 wherein said side edges of the lid extending from said hinge such that when said lid is in its closed position, said outwardly angled lid side edges are inboard of and contiguous to the outwardly angled inner edges of said shoulders.

82. The closure as set forth in claim 81 wherein said lid outer edge is opposite said hinge and is defined by the distal ends of said side edges, said outer edge being substantially co-extensive with the periphery of said skirt between distal ends of said shoulders.

83. The closure of claim 72 wherein each shoulder being integrally formed as an upward extension of the end wall wherein the end wall has no upward extension spaced apart upwardly from the plane of the end wall other than the shoulders and each shoulder includes an upward extension of the skirt that is spaced upwardly from the upper end of the skirt to the top shoulder surface, and wherein each of the shoulders has a substantially solid formation.

84. The closure as set forth in claim 83 wherein the end wall has a lower surface that is substantially planar and free of a void in the region below the shoulders.

85. The closure as set forth in claim 72 wherein the end wall has an area defined by the upper end of the skirt and wherein the lid is dimensioned to cover the area of the end wall free of the shoulders and to cover the upper end of the skirt free of the shoulders when the lid is in the closed position.

86. The closure as set forth in claim 85 wherein the one or more openings is a single opening and wherein the single opening defines an open area covering a substantial portion of the area of the end wall located between the two shoulders and towards an outer portion of the end wall on a side opposing the hinge.

87. The closure as set forth in claim 85 wherein the lid is dimensioned to cover all of the area of the end wall including the upper end of the skirt other than the shoulders.

* * * * *